US010940489B2

(12) United States Patent
Hagqvist et al.

(10) Patent No.: US 10,940,489 B2
(45) Date of Patent: Mar. 9, 2021

(54) CENTRIFUGAL SEPARATOR WITH DISC STACK HAVING DISCS OF DIFFERENT DIAMETERS

(71) Applicant: ALFA LAVAL CORPORATE AB, Lund (SE)

(72) Inventors: Peter Hagqvist, Stockholm (SE); Olle Törnblom, Tullinge (SE); Torbjörn Larsen, Ösmo (SE); Björn Wernerson, Älvsjö (SE); Galya Simeonova, Hägersten (SE); Mustafa Rasol, Tumba (SE)

(73) Assignee: ALFA LAVAL CORPORATE AB, Lund (SE)

( * ) Notice: Subject to any disclaimer, the term of this patent is extended or adjusted under 35 U.S.C. 154(b) by 713 days.

(21) Appl. No.: 15/568,628

(22) PCT Filed: Apr. 22, 2016

(86) PCT No.: PCT/EP2016/058961
§ 371 (c)(1),
(2) Date: Oct. 23, 2017

(87) PCT Pub. No.: WO2016/170090
PCT Pub. Date: Oct. 27, 2016

(65) Prior Publication Data

US 2018/0141057 A1 May 24, 2018

(30) Foreign Application Priority Data

Apr. 24, 2015 (EP) ..... 15165034

(51) Int. Cl.
*B04B 1/08* (2006.01)
*B04B 7/14* (2006.01)
(Continued)

(52) U.S. Cl.
CPC ..... *B04B 1/08* (2013.01); *B04B 7/14* (2013.01); *B04B 9/02* (2013.01); *B04B 11/02* (2013.01);
(Continued)

(58) Field of Classification Search
CPC .. B04B 1/08; B04B 9/02; B04B 11/02; B04B 7/14; B04B 5/005; F01M 2013/0422
(Continued)

(56) References Cited

U.S. PATENT DOCUMENTS 1,760,071 A * 5/1930 Koepke ..... B04B 1/08 494/67
2,261,724 A * 11/1941 Holm ..... C10G 73/28 208/31
(Continued)

FOREIGN PATENT DOCUMENTS

CN 2266774 Y 11/1997
CN 101898173 A 12/2010
(Continued)

OTHER PUBLICATIONS

International Search Report, issued in PCT/EP2016/058961, dated Jun. 22, 2016.
(Continued)

*Primary Examiner* — Charles Cooley
(74) *Attorney, Agent, or Firm* — Birch, Stewart, Kolasch & Birch, LLP

(57) ABSTRACT

A centrifugal separator includes a frame and a drive member configured to rotate a rotating part in relation to the frame around an axis of rotation. The rotating part includes a centrifuge rotor closing a separation chamber. The separation chamber includes a stack of separation discs arranged coaxially around the axis of rotation at a distance from each other such as to form passages between each two adjacent
(Continued)

separation discs. The stack of separation discs includes a first type of separation discs having an outer diameter of A or below, and at least one separation disc of a second type having outer diameter B or above, wherein diameter B is larger than diameter A. At least one of the separation discs of the second type is arranged at a position in the disc stack that is within the upper 15% of the total number of separation discs and at least one of the first type of separation disc is arranged axially above the uppermost separation disc of the second type.

18 Claims, 3 Drawing Sheets

(51) Int. Cl.
*B04B 9/02* (2006.01)
*B04B 11/02* (2006.01)
*B04B 5/00* (2006.01)
*F01M 13/04* (2006.01)

(52) U.S. Cl.
CPC ..... *B04B 5/005* (2013.01); *F01M 2013/0422* (2013.01)

(58) Field of Classification Search
USPC ..... 494/64, 67–73
See application file for complete search history.

(56) References Cited

U.S. PATENT DOCUMENTS 2,313,540 A 3/1943 Hall
2,403,089 A * 7/1946 Lars ..... B04B 1/04 494/42
2,599,619 A * 6/1952 Eckers ..... B04B 1/08 494/28
2,622,796 A * 12/1952 Steinacker ..... B04B 5/06 494/10
2,715,994 A * 8/1955 Steinacker ..... B04B 5/06 494/22
2,731,331 A * 1/1956 Strezynski ..... B04B 5/06 422/259
3,117,928 A * 1/1964 Thylefors ..... B04B 1/08 494/27
3,279,689 A * 10/1966 Honeychurch ..... B04B 1/08 494/27
3,328,282 A * 6/1967 Keith, Jr. ..... B04B 1/10 208/28
3,335,946 A * 8/1967 Putterlik ..... B04B 7/14 494/73
3,484,040 A * 12/1969 Honeychurch ..... B04B 1/12 494/35
3,529,767 A * 9/1970 Keith, Jr. ..... C10G 73/28 494/27
3,534,903 A * 10/1970 Keith, Jr. ..... C10G 31/10 494/22
4,427,407 A * 1/1984 Paschedag ..... B04B 1/12 494/70
4,721,505 A * 1/1988 Inge ..... B04B 1/08 494/74
5,921,909 A * 7/1999 Gustafsson ..... B04B 1/08 494/70
7,410,457 B2 * 8/2008 Heinrich ..... B04B 1/08 494/70
2008/0015099 A1 * 1/2008 Heinrich ..... B04B 11/06 494/68
2010/0011723 A1 1/2010 Szepessy et al.
2014/0221187 A1 8/2014 König et al.
2015/0119225 A1 * 4/2015 Inge ..... B04B 5/12 494/70
2015/0126353 A1 * 5/2015 Hagqvist ..... B04B 1/08 494/72
2015/0283558 A1 * 10/2015 Konigsson ..... B04B 7/14 494/74
2020/0376500 A1 * 12/2020 Hagqvist ..... B04B 7/14

FOREIGN PATENT DOCUMENTS

CN 102099120 A 6/2011
CN 203155399 U 8/2013
CN 103547374 A 1/2014
CN 203990959 U 12/2014
CN 104284732 A 1/2015
DE 195 08 334 A1 9/1996
EP 2664385 A1 * 11/2013
GB 1207500 A * 10/1970 ..... B04B 1/08
JP 39-26606 A 11/1964
JP 57-119859 A 7/1982
JP 59-184950 U 12/1984
JP 8-257438 A 10/1996
JP 11-506383 A 6/1999
SE 22981 8/1907
SE 227 107 7/1969
WO WO 96/25234 A1 8/1996
WO WO 2013/171160 A1 11/2013

OTHER PUBLICATIONS

Written Opinion of the International Searching Authority, issued in PCT/EP2016/058961, dated Jun. 22, 2016.
Japanese Office Action, dated Jan. 4, 2019, for Japanese Application No. 2017-555515, with an English translation.
English translation of the Japanese Office Action, dated Jul. 29, 2019, for Japanese Application No. 2017-555515.
English translation of the Chinese Office Action and Search Report dated Mar. 4, 2019, for counterpart Chinese Application No. 201680036901.3.

* cited by examiner

CENTRIFUGAL SEPARATOR WITH DISC STACK HAVING DISCS OF DIFFERENT DIAMETERS

FIELD OF THE INVENTION

The present invention relates to the field of centrifugal separators, and more particularly for a disc package for a centrifugal separator.

BACKGROUND OF THE INVENTION

Centrifugal separators are generally used for separation of liquids and/or for separation of solids from a liquid. During operation, liquid mixture to be separated is introduced into a rotating bowl and heavy particles or denser liquid, usually water, accumulates at the periphery of the rotating bowl whereas less dense liquid accumulates closer to the central axis of rotation. This allows for collection of the separated fractions, e.g. by means of different outlets arranged at the periphery and close to the rotational axis, respectively.

From the early days of development of centrifugal separators it is known to provide each separation disc in a disc package with a brim extending radially outside the frustoconical portion of the disc, in order to improve the mechanical stability of the discs, see e.g. SE 22981.

A disc stack having a single separation disc provided with a brim extending radially outside the rest of the separation discs of a disc stack is also previously known, see SE 227107. This is used to divide the disc stack into a first section where the cleaning of the light phase is optimised (purifier mode of operation) and a second section where the cleaning of the heavy phase is optimised (concentrator mode of operation).

Furthermore, WO 2013/171160 discloses a separator comprising a first and a second set of separation discs, wherein the discs of the second set have an outer diameter B that is larger than the diameter of the first set and wherein at least two separation discs of the first set is arranged between every two separation discs of the second set.

A property of a centrifugal separator related to the through-put capacity is the certified flow rate (CFR). The CFR is generally defined as the flow rate where the separation efficiency is 85% 30 min after the centrifuge rotor of has been discharged.

However, there is a need in the art for separator having increased through-put capacity.

SUMMARY OF THE INVENTION

A main object of the present invention is to provide a centrifugal separator having increased through-put capacity, e.g. for heavy fuel oil or lubrication oil.

As a first aspect of the invention, there is provided a centrifugal separator comprising a frame, a drive member configured to rotate a rotating part in relation to the frame around an axis of rotation (x), wherein the rotating part comprises a centrifuge rotor enclosing a separation chamber;

wherein the separation chamber comprises a stack of separation discs arranged coaxially around the axis of rotation (X) at a distance from each other such as to form passages between each two adjacent separation discs, and further wherein the stack of separation discs comprises a first type of separation discs having an outer diameter of A or below, and at least one separation disc of a second type having outer diameter B or above, wherein diameter B is larger than diameter A, and wherein at least one of the separation discs of the second type is arranged at a position in the disc stack that is within the upper 15% of the total number of separation discs and wherein at least one of said first type of separation disc is arranged axially above the uppermost separation disc of the second type.

The centrifugal separator is for separation of a fluid mixture, such as a gas mixture or a liquid mixture. The fluid mixture may be oil. The frame of the centrifugal separator is a non-rotating part, and the rotating part is supported by the frame by at least one bearing device, which may comprise a ball bearing. The rotating part of the separator comprises a centrifuge rotor. The centrifuge rotor is usually supported by a spindle, i.e. a rotating shaft, and may thus be mounted to rotate with the spindle. The spindle is thus rotatable around the axis of rotation. The centrifugal separator may be arranged such that the centrifuge rotor is supported by the spindle at one of its ends, such at the bottom end or the top end of the rotor The centrifuge rotor encloses by rotor walls a separation chamber in which the separation of the fluid mixture takes place. The separator also comprises an inlet for fluid to be separated and at least one outlet for fluid that has been separated. The centrifuge rotor may further comprise at its outer periphery a set of radially sludge outlets in the form of intermittently openable outlets. These may be for discharge of higher density component such as sludge or other solids in the fluid to be separated. The centrifuge rotor may also comprise at its outer periphery open nozzles through which certain flow of sludge and/or heavy phase is discharged continuously.

The drive member for rotating the rotating part of the separator may comprise an electrical motor having a rotor and a stator. The rotor may be fixedly connected to the rotating part. Advantageously, the rotor of the electrical motor may be provided on or fixed to the spindle of the rotating part. Alternatively, the drive member may be provided beside the spindle and rotate the rotating part by a suitable transmission, such as a belt or a gear transmission.

The separation chamber further comprises a stack of separation discs. The stack comprises a first type of separation discs and at least one of a second type of separation discs. Each separation disc of the first and second type is provided with a separation portion having a separation surface with is inclined with respect to the radial direction. The separation surfaces may be a frustoconical portion of the separation discs. The angle of inclination of the separation surface may be within the range of 30-50 degrees, preferably about 40 degrees, to the radial direction.

The separation discs of the first and second type are arranged coaxially around the axis of rotation at a distance from each other such that to form passages between each two adjacent separation discs. The separation discs are preferably arranged such that the base portions of the inclined separation portions of the separation discs in the disc package are facing in the same direction. The separation discs in the disc package may be arranged such that the fluid to be separated flows radially inwards in the passages between each two adjacent separation discs of any of the two sets.

The disc stack of separation discs are arranged on a distributor. In the present disclosure, the axial directions are defined such that the disc arranged axially above another disc is arranged further away from the distributor. The disc arranged on the distributor thus forms the axially bottom position, whereas the disc furthers away from the distributor form the axially uppermost position.

Thus, the upper part of the disc stack is further away from the distributor as compared to the lower part of the disc stack.

The outer diameters of the separation discs of the first type may vary as long as they have an outer diameter of A or below. Alternatively the separation discs of the first type have an outer diameter A. Similarly, the outer diameters of the separation discs of the second type may vary as long as they have an outer diameter of B or above. Alternatively every separation disc of the second type may have an outer diameter B.

Furthermore, the disc package is arranged such that at least one of the separation discs of the second type is arranged at a position in the disc stack that is within the upper 15% of the total number of separation discs. The upper part is thus the part of the disc stack axially furthest away from the distributor. In other words, if the disc stack consists of N number of discs and position $P_1$ is closest to the top disc and position $P_N$ is the position closest to the distributor, then the disc stack comprises at least one disc of the second type having position $P_n$, wherein $n/N \leq 0.15$. Thus, n runs from 1 to N.

Furthermore, the discs are arranged such that at least one of said first type of separation disc is arranged axially above the uppermost separation disc of the second type. This means that the uppermost disc in the disc stack is not a disc of the second type. As an example, at least one, such as at least two, such as at least five, such as at least ten of said first type of separation discs may be arranged axially above the uppermost separation disc of the second type.

However, in embodiments, the disc stack is arranged between a distributor and an upper top disc. The top disc is not a disc of the second type. The top disc may however have a radius that is larger than the separation discs of the first type in order to guide separated liquid out of the separator. A top disc may further have a larger thickness as compared to the separation disc of the disc stack.

The interior wall of the rotor may be provided with a wall portion, which may be conical, and the separation discs of the second type may be arranged in the disc stack such that there is a passage between the outer periphery of each disc and the rotor wall portion of at least 1 mm, preferably at least 1.5 mm.

The first aspect of the invention is based on the insight that having a disc stack with a disc with a larger diameter in the top part increases the certified flow rate (CFR) of the separator, i.e. it increases the through put capacity. It has been verified during testing that the position of the disc with the larger diameter as according to the first aspect may increase the CFR with up to 10%.

This effect may be due to less remixing of an already separated phase as it leaves the disc stack in the radial direction, i.e. the discs of the larger diameter may prevent or decrease the risk of the phase that has been separated within the disc stack and leaves the discs stack radially outwards to be mixed with the fluid mixture that enters the disc stack.

In embodiments of the first aspect of the invention, at least one of the separation discs of the second type is arranged at a position in the disc stack that is within the upper 5-15% of the total number of separation discs, such as within the upper 5-12% of the total number of separation discs.

In embodiments of the first aspect of the invention, at least one of the separation discs of the second type is arranged at a position in the disc stack that is within the upper 10-12% of the total number of separation discs.

Thus, in analogy with the definitions above, if the disc stack consists of N number of discs and position $P_1$ is the uppermost position and position $P_N$ is the position closest to the distributor, then the disc stack comprises at least one disc of the second type having position $P_n$, wherein $0.10 \leq n/N \leq 0.12$. This has proved to give an increased certified flow rate.

In embodiments of the first aspect of the invention, the diameter B is 3-15% larger than diameter A, such as 4-14% larger than diameter A. The diameter may also be 5-12% larger than diameter A.

Further, the diameter B may be 10-50 mm, such as 10-25 mm larger than diameter A. Thus the risk of separated particles being recirculated into the separating passages of the disc package is minimised while maintaining an open space for separation radially outside the disc package.

The separation discs of the first and second type may extend from a common inner radial position. The radial extent and inclination of the inclined separation portion may be similar over the separation discs of the two types and over the disc package as a whole.

Furthermore, the centrifugal separator may comprise less than 10 discs of the second type, such as less than five, such as less than three, such as less than two discs of the second type.

In embodiments of the first aspect of the invention, the discs of the second type are distributed in the stack such that more discs of the second type are arranged within the upper 15% of the total number of separation discs than arranged within the rest of the disc stack, i.e within the lower 85% of the total number of discs.

Thus, as an example, the discs of the second type are distributed in the stack such that more discs of the second type are arranged within the upper 15% than arranged within the rest of the disc stack and at least at least one, such as at least two, such as at least five, such as at least ten of the first type of separation discs are arranged axially above the uppermost separation disc of the second type.

In embodiments of the first aspect, at least 50% of the separation discs of the second type are arranged at a position in the disc stack that is within the upper 15% of the total number of separation discs.

In embodiments of the first aspect, all discs of the second type are arranged within the upper 15% of the total number of separation discs, such as within the upper 10-12% of the total number of separation discs.

In embodiments of the first aspect of the invention, the disc stack comprises a single separation disc of the second type. This single disc of the second type is thus arranged within the upper 15% of the total number of separation discs, such as within the upper 10-12% of the total number of separation discs.

Accordingly, a lower portion of the disc package closest to the distributor, i.e. at the bottom end of the stack, may be provided only with separation discs of the first type.

Thus, in embodiments of the first aspect, all of the separation discs of the second type are arranged within the upper 50% of the total number of separation discs.

As an example, the centrifugal separator may comprise less than 10 discs of the second type, such as less than five, such as less than three, such as less than two discs of the second type, all arranged within the upper 50% of the total number of separation discs, such as within the upper within the upper 25% of the total number of separation discs, such as within the upper 15% of the total number of separation discs.

In embodiments of the first aspect of the invention, all separation discs of the first type and the second type have a separation surface with the same inclination with respect to the radial direction that extend to radial position A.

Thus, the separation disc of the first type may have a separation surface with the same inclination with respect to the radial direction that extend to the outer diameter of the separation disc.

In embodiments of the first aspect of the invention, the separation disc of the second type has a separation surface with the same inclination with respect to the radial direction that extend to the outer diameter of the separation disc.

Thus, the separation discs of the second type may be free of any brim portions, as explained below. Further, the inclined separation surface of each separation disc of the first type may extend to the outer diameter of the separation disc. Thus, also the separation discs of the first type may be provided essentially without any brim portion, maximising the separation surface.

In embodiments of the first aspect of the invention, the separation disc of the second type has a brim portion formed radially outside the diameter A, which brim portion has an inclination to the radial direction which is different from the inclination of the separation surface.

The radial extent of the brim portion may be 1.5-7.5%, preferably 2.5-6% of diameter A, or the radial extent of the brim portion may be 7-25 mm, preferably 10-15 mm.

The radial extent of the inclined separation surface may be similar for the separation discs of the first and second type.

As an example, the angle of the brim portion to the radial direction may be less than 45 degrees, preferably less than 30 degrees, more preferably less than 15 degrees, most preferably zero degrees.

If the angle is close to zero or zero, i.e. the brim portion is in a plane perpendicular to the axis of rotation, the brim portion acts to define a flow zone radially outside the separation discs of the first type without acting as a separation surface. Thus, the inclined separation surface of each separation disc of the second type may extend to the diameter A. The angle of the brim portion may be the same or may vary over the separation discs of the second type in the disc stack.

The brim portion may be ring shaped and the surface of the brim portion may be plain and formed as a continuous sheet of material circumventing the separation surface, thereby being provided essentially without any holes or protrusions. Thus the amount of turbulence caused by the brim portion is minimised.

In embodiments of the first aspect of the invention, the passages formed between each two adjacent separation discs are in the form of caulks having a thickness that is less than 0.6 mm, such as about 0.5 mm.

Thus, the passages between the discs in the stack may have an axial distance that is less than 0.6 mm, such as about 0.5 mm. The caulks may be spot-formed and/or formed as elongated strips. The caulks may be on the top surface or the bottom surface of each disc. The top surface is thus the surface facing the away from the distributor, whereas the bottom surface is the surface facing the distributor.

In embodiments of the first aspect of the invention, the passages formed between each two adjacent separation discs are in the form of elongated straight caulks. Straight caulks are in the form of strips that extend from an inner radius to an outer radius on the surface of the disc. The straight elongated caulks may extend in a direction that forms an angle with the radius of the disc.

In embodiments, the passages formed between each two adjacent separation discs are in the form of radial caulks. Radial caulks are straight caulks extending in the radial direction from rotational axis X.

In embodiments of the first aspect of the invention discs of the first type are provided with slits arranged at the perimeter of the disc such that to distribute the flow of fluid to be separated through and over the disc stack.

The separation discs of the first type may be provided with cut-outs in the form of slits which are cut-outs that are open towards the outer radius of the separation disc. This has the effect that the risk of clogging in the area of the cut outs is minimised.

Furthermore, in embodiments of the first aspect at least one disc of the second type is provided with through holes that are radially aligned with the slits in the discs of the first type.

Thus, the separation discs of the second type may be provided with cut-outs in the form of holes that are closed towards the outer radius of the separation disc. This has the effect to improve the mechanical properties of the separation discs of larger diameter, to be able to cope with the centrifugal forces. The through holes in the discs of the second type are radially aligned with the slits of the first type, thereby forming axially rising channels throughout the disc stack. The fluid to be separated may thus be axially transported through such rising channels so as to be distributed over the disc stack.

Thus, in embodiments of the first aspect of the invention, all discs in the stack have the same number of through holes or cut outs that form rising channels axially through the disc stack.

The combination of cut-outs in the form of slits on the separation discs of the first type and cut-outs in the form of holes on separation discs of the second type further minimises the risk of clogging in the area of the cut-outs on the separation discs of the second type.

Furthermore, in embodiments of the first aspect of the invention, the discs of the second type are free of through holes in the outermost region, which is the region between A and B.

However, the discs of the second type may also be free of through holes in the separation surface. For example, the separator may contain a single disc of the second type, and this single disc may be free of through holes in the separation surface.

In embodiments of the first aspect of the invention, the centrifugal separator comprises a single stack of separation discs.

As a configuration of the first aspect of the invention, there is provided a centrifugal separator comprising

- a frame, a drive member configured to rotate a rotating part in relation to the frame around an axis of rotation (x), wherein the rotating part comprises a centrifuge rotor enclosing a separation chamber;
- wherein the separation chamber comprises a single stack of separation discs arranged coaxially around the axis of rotation (X) at a distance from each other such as to form passages between each two adjacent separation discs,
- wherein the stack of separation discs comprises a first type of separation discs having an outer diameter of A or below, and at least one separation disc of a second type having outer diameter B or above, wherein diameter B is larger than diameter A, and wherein at least 50% of the separation discs of the second type are arranged at a position in the disc stack that is within the upper 25% of the total number of separation discs and wherein at least one of said first type of separation disc is arranged axially above the uppermost separation disc of the second type.

As an example, all of the separation discs of the second type may be arranged at a position in the disc stack that is within the upper 25% of the total number of separation discs.

As an example, the centrifugal separator may comprises single disc of the second type that is arranged within the upper 25% of the total number of separation discs.

As a further example, all discs in the stack may have the same number of through holes or cut outs to form rising channels extending axially through the disc stack.

As a second aspect of the invention, there is provided a method of separating impurities from oil comprising the steps of a) providing a centrifugal separator according to the first aspect of the invention and rotating said rotating part of said separator
b) introducing the oil into the separation chamber; and
c) discharging purified oil and separated impurities as two different phases from said separator.

The impurities may comprise particles. The separated particles may be discharged via the set of radially sludge outlets in the form of intermittently openable outlets arranged at the outer periphery of the centrifuge rotor. The purified oil may be discharged via an outlet arranged axially above a top disc.

The oil may be fuel oil or lubrication oil. Furthermore, the oil may be selected from heavy fuel oil (HFO) and lubrication oil. HFO may be defined as in ISO 8217, Petroleum products—Fuels (class F)—Specification of marine fuels. Editions 2005 and 2012. Furthermore, the impurities may comprise catalyst fines (cat fines). Catalyst fines are residues from the refining process of crude oil known as catalytic cracking, wherein long hydrocarbon molecules are cracked into shorter molecules. These particles are undesired in the fuel oil since they are abrasive and may cause wear in the engine and auxiliary equipment. The concentration of catalyst fines in the fuel oil normally varies between 0 and 60 ppm. Catalyst fines may be in the size range from 0.1 microns (micrometres) to 100 microns.

DETAILED DESCRIPTION

The centrifugal separator according to the present disclosure will be further illustrated by the following description with reference to the accompanying drawings.

Figure 1A:
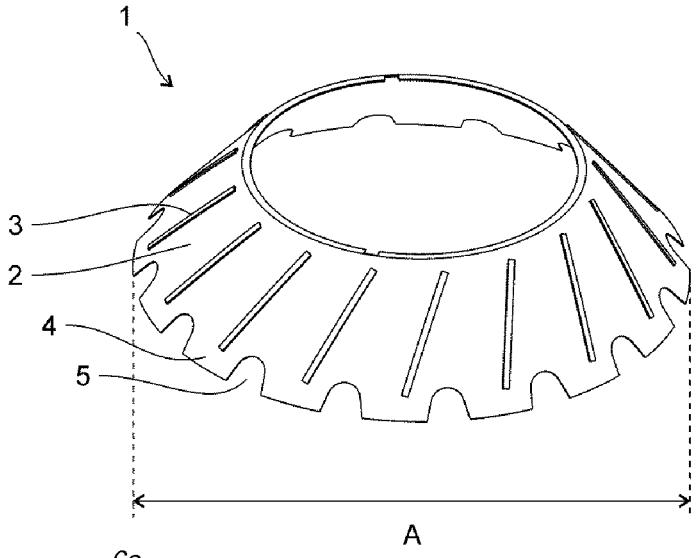
FIG. 1 shows perspective views of embodiments of separation discs.

In FIG. 1*a* a separation disc 1 of first type in the disc stack is shown, having a frustoconical separation portion 2 with an inner and an outer separation surface. The separation portion is provided with a plurality of distance members in the form of straight elongated caulks 3 providing distances to form passages between each two adjacent separation discs in a stack formed by a stack of separation discs. The caulks 3 in FIG. 1*a* form in an angle with the radius of the disc 1, but the caulks could also be straight radial caulks, i.e. caulks that do not form an angle with the radius of the disc 1. The caulks are fastened to the outer surface of the frustoconical separation portion of the disc and distributed around the circumference of the disc. The caulks may also or as an alternative be provided on the inner surface of the disc. The caulks may also be formed as an integral part of the disc.

The outer diameter A of the separation disc is in this embodiment 308 mm and the inclined separation surface extend all the way out to this outer diameter. Thus the radially outer portion 4 of the separation disc is part of the inclined separation surface. The disc is provided with a plurality of cut-outs in the form of slits 5 at this radially outer portion 4 of the separation disc, which slits are open towards the outer radius of the separation disc. The number of slits 5 correspond to the number of caulks and the slits are distributed around the circumference of the disc in-between the caulks.

Figure 1B:
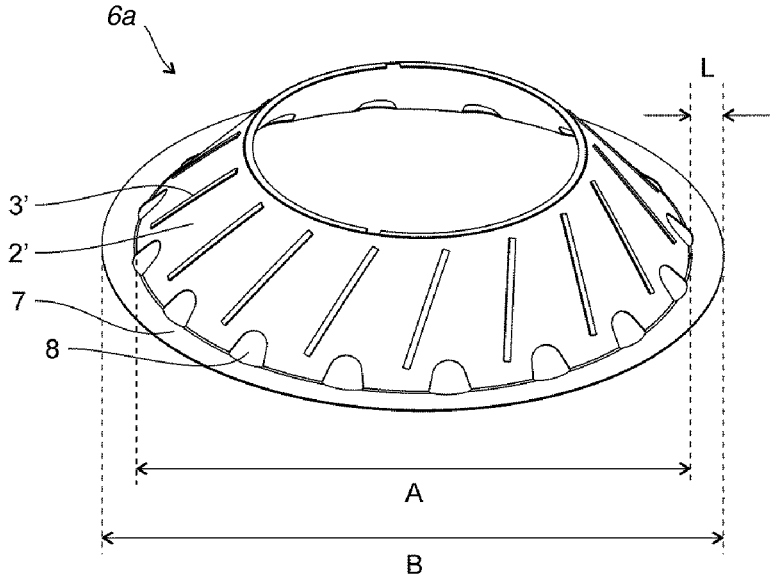

In FIG. 1*b* separation disc 6*a* of the second type in the disc stack is shown, having a frustoconical separation portion 2' with an inner and an outer separation surface. The separation portion is provided with a plurality of distance members in the form of straight elongated caulks 3' providing distances to form passages between each two adjacent separation discs in a stack formed by a stack of separation discs. The caulks 3' in FIG. 1*b* form in an angle with the radius of the disc 1, but the caulks could also be straight radial caulks, i.e. caulks that do not form an angle with the radius of the disc 1. The caulks are fastened to the outer surface of the frustoconical separation portion of the disc and distributed around the circumference of the disc. As with the disc in FIG. 1*a*, the caulks may also or as an alternative be provided on the inner surface of the disc. The caulks may also be formed as an integral part of the disc. The separation surface extend to the diameter A and radially outside the separation surface the disc is provided with a flat brim 7 (i.e. having an angle of zero degrees to the radial direction) extending to the outer diameter of the separation disc B. The diameter B is in this embodiment 328 mm and the diameter A is in this embodiment 308 mm. The radial extension L of the brim is $L=(B-A)/2$, i.e. 10 mm. The diameter B is thus 6.5% larger than the diameter A. The disc is provided with a plurality of cut-outs in the form of through holes 8 at the radially outer part of the separation portion, which cut-outs are closed towards the outer radius of the separation disc by means of the brim. The number of holes 8 corresponds to the number of caulks and the holes are distributed around the circumference of the disc at positions corresponding to the slits of the separation disc 1 in the first type.

Figure 1C:
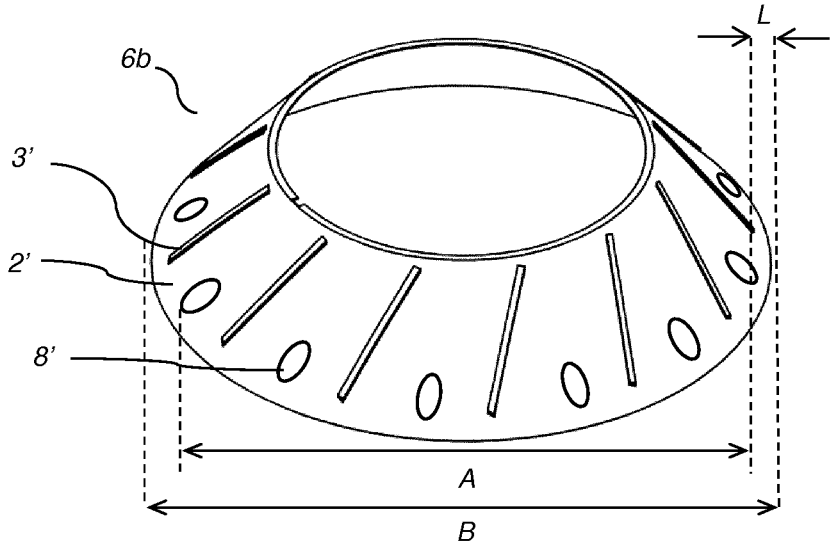

FIG. 1*c* shows a further example of a separation disc 6*b* of the second type. The disc 6*b* has a frustoconical separation portion 3' and straight elongated caulks 3' as described in relation to FIG. 1*b*, but in contrast to the disc in FIG. 1*b*, the inclined separation surface of the frustoconical separation surface 2"extend all the way out to the outer diameter B. The diameter B is in this embodiment 328 mm, i.e. it extends radially a distance L of 10 mm compared to a disc having a diameter of A=308 mm. The separation disc 6*b* is further provided with a plurality through holes 8' that ends at a radial distance of A/2, which means when arranged above or below a separation disc 1 of the first type, the through holes 8' may be radially aligned with the slits 5 of the separation disc 1 of the first type to form distribution channels.

Figure 2:
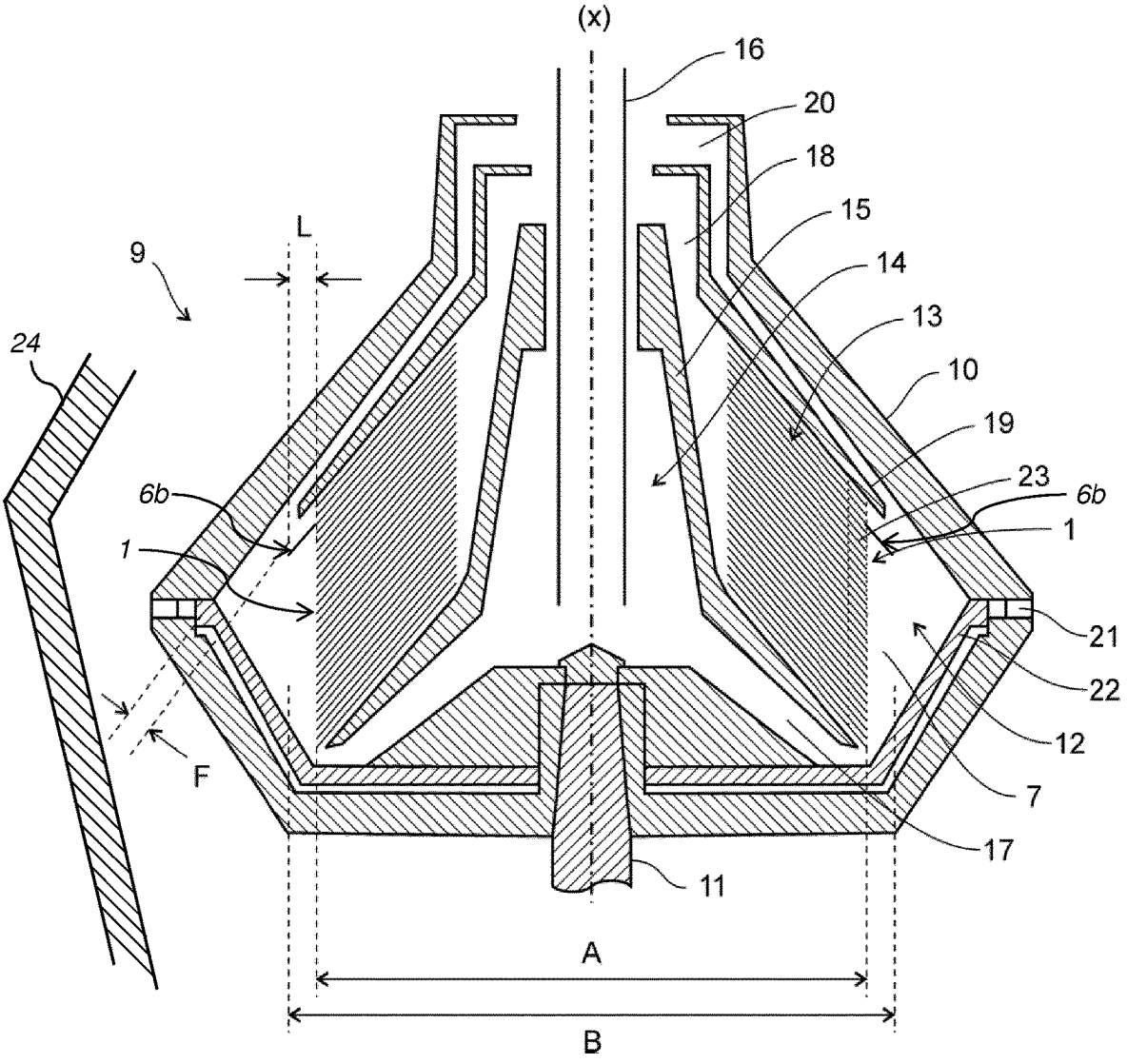
FIG. 2 shows a portion of an embodiment of a centrifugal separator.

FIG. 2 shows a portion of a centrifugal separator 9 for separation of a liquid mixture of components, the separator having a rotor 10 supported by a spindle 11 (partly shown) which is rotatably arranged in a frame 24 (partly shown in FIG. 2) around an axis of rotation (x). The rotor forms within itself a separation chamber 12 wherein a disc stack 13 is arranged. In the separation chamber 12 centrifugal separation of e.g. a liquid mixture to takes place during operation. The rotor further comprises an inlet chamber 14 formed within a distributor 15 into which a stationary inlet pipe 16 extends for supply of a liquid mixture of components to be separated. The inlet chamber communicates with the separation chamber via passages 17 formed in the rotor. The radially inner portion of the disc stack communicates with an outlet 18 for a lighter liquid component of the mixture. The outlet 18 is delimited by a top disc 19 provided at the upper axial end of the disc stack 13. The top disc 19 and the upper wall part of the rotor 10 delimits a passage for a denser liquid component of the mixture, the passage extending from the radially outer part of the separation chamber 12 to an outlet 20 for the a heavier component of the liquid mixture. The rotor is further provided with outlets 21 from the radially outer periphery of the separation chamber 12 for intermittent discharge of a sludge component of the liquid mixture comprising denser particles forming a sludge phase. The opening of the outlets 21 is controlled by means of an operating slide 22 actuated by operating water, as known in the art.

The disc stack 13 comprises a first and a second type of separation discs, the first type comprising separation discs 1 of the kind shown in FIG. 1*a*, and the second type comprising a separation disc 6*b* of the kind shown in FIG. 1*c*. The separation discs are arranged coaxially around the axis of rotation (x) at a distance from each other by means of the caulks 3, 3', such that to form passages between each two adjacent separation discs. The passages extend from the radially outer portions of the separation discs to the radially inner portions of the separation discs. In the figure the distance between each separation disc is exaggerated and the disc stack is schematically shown to have 28 discs. A typical disc stack comprises 80-180 discs and a typical distance between the separation discs, generated by the caulks, may be below 0.75 mm, such as below 0.6 mm, such as about 0.5 mm. In embodiments, the distance between the separation discs are 0.4-0.75 mm, such as 0.4-0.6 mm, such as about 0.4-0.5 mm.

The single disc 6*b* of the second type is arrange at a position in the disc stack 13 that is within the upper 10-12% of the total number of separation discs. In this embodiment, the rest of the disc stack contains only separation discs 1 of the first type.

The cut-outs in the form of slits on the separation discs 1 of the first type and the cut-outs in the form of holes on the separation disc 6*b* of the second type are aligned in the disc stack to form axial distribution channels 23 for the liquid mixture.

The clearance F between the radially outer end of the separation disc 6*b* of the second type and the interior wall of the rotor may be at least 1.5 mm and the radial extension L of the second type of separation disc 6*b* from the perimeter of the first type of separation disc 1 may be about 10 mm.

During operation of the separator in FIG. 2, the rotor 10 is caused to rotate by torque transmitted from a drive motor (not shown) to the spindle 11. Via the inlet pipe 16, liquid material to be separated is brought into the inlet chamber and is further led via passages 17 to the separation chamber 12. Depending on the density, different phases in the liquid is separated in the disc stack 13 fitted in separation chamber 12. Heavier components in the liquid move radially outwards between the separation discs, whereas the phase of lowest density moves radially inwards between the separation discs and is forced through outlet 18 arranged at the radial innermost level in the separator. The liquid of higher density is instead forced out through outlet 20 that is at a radial distance that is larger than the radial level of outlet 18. Thus, during separation, an interphase between a liquid of lower density and the liquid of higher density is formed in the separation chamber 12. Solids, or sludge, accumulate at the periphery of the separation chamber 12 and is emptied intermittently from the separation chamber by the sludge outlets 21 being opened, whereupon sludge and a certain amount of fluid is discharged from the separation chamber by means of centrifugal force. However, the discharge of sludge may also take place continuously, in which case the sludge outlets 21 take the form of open nozzles and a certain flow of sludge and/or heavy phase is discharged continuously by means of centrifugal force.

Figure 3A:
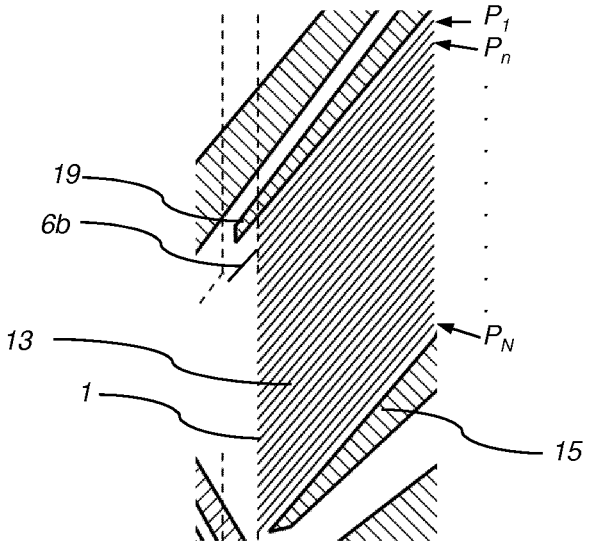
FIG. 3 further shows the position of the second type of discs within the disc stack.

FIG. 3*a* shows a close up of the disc stack 13 of FIG. 2 comprising a single disc 6*b* of the second type, whereas the rest of the discs are of the first type 1. As stated in relation to FIG. 2, the distance between each separation disc is exaggerated and the disc stack is schematically shown to have 28 discs. A typical disc stack comprises 80-180 discs. The disc stack 13 may thus comprises N number of discs, i.e. N may be 80-180, and be arranged at positions $P_1$ to $P_N$, wherein position 1 is the upper position closest to the top disc 19 and position $P_N$ is closest to the distributor 15. The single disc 6*b* is then positioned at position $P_n$, wherein $n/N \leq 0.15$. As an example, if the disc stack comprises N=100 discs, then the disc 6*b* is positioned at position $P_n$, wherein $n \leq 15$. Thus, the disc 6*b* is within the upper 15 discs, such as at position 10, 11, or 12.

Figure 3B:
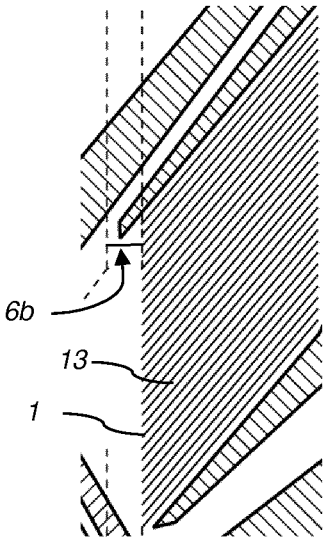

FIG. 3*b* shows a further embodiment of a disc stack 13 comprising a single disc 6*b* of the second type and the rest of the discs of the first type 1, but wherein the single disc has a brim portion, i.e. a disc as described in relation to FIG. 1*b*. The single disc is arranged at a position in the disc stack that is within the upper 15% of the total number of separation discs, such as within the upper 10-12% of the total number of separation discs.

Figure 3C:
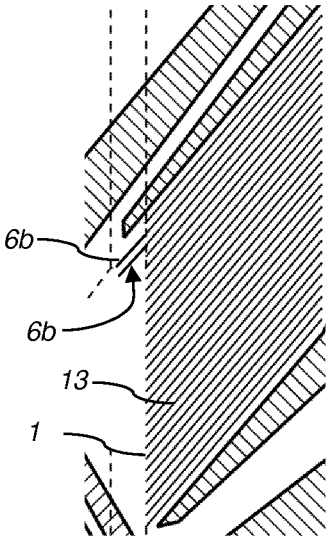

FIG. 3*c* shows an embodiment of a disc stack 13 comprising two discs 6*b* of the second type as described in relation to FIG. 1*c* and the rest of the discs of the first type 1. Both discs are arranged at positions in the disc stack that is within the upper 15% of the total number of separation discs, within the upper 10-12% of the total number of separation discs.

Figure 3D:
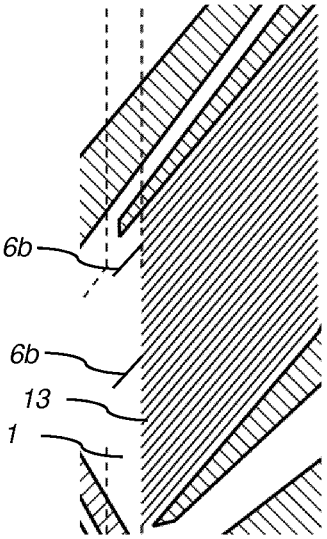

FIG. 3*d* shows an embodiment of a disc stack 13 comprising two discs 6*b* of the second type as described in relation to FIG. 1*c* and the rest of the discs of the first type 1. In this example, one of the discs 6*b* is arranged at a position in the disc stack that is within the upper 15% of the total number of separation discs, such as within the upper 10-12% of the total number of separation discs, whereas the second of the discs 6*b* is arranged approximately in the middle of the disc stack 13.

The invention is not limited to the embodiment disclosed but may be varied and modified within the scope of the claims set out below. The invention is not limited to the orientation of the axis of rotation (X) disclosed in the figures. The term "centrifugal separator" also comprises centrifugal separators with a substantially horizontally oriented axis of rotation.

Experimental Example 1

Material and Methods

The Certified flow rate (CFR) was tested in a marine centrifugal separator suitable for separating heavy fuel oil (HFO). The CFR was tested in a test rig according to the DNV standard for certification No. 2.9 Type Approval Programme 776.60 using liquids of two different densities, 35 cSt and 55 cSt, respectively. Four different disc stack configurations were used; one reference, which was a disc stack only comprising discs of the first type, and three configurations also comprising discs of the second type. The differences in configurations are summarized in Table 1 below:

TABLE 1

Disc stack configurations for Experimental Example 1.

| Disc stack configuration No | Total number of discs (N) | Discs of larger diameter (second type) | Pn/PN |
|---|---|---|---|
| Reference | 160 | — | — |
| 1 | 160 | 15 discs in the middle of the stack, starting at position n = 16 from the top and arranged as every eighth disc. | — |
| 2 | 160 | Single disc at position n = 18 from the top | 0.1125 |
| 3 | 160 | Single disc at position n = 8 from the top | 0.05 |

The discs of the first type in the disc stacks of all configurations had a diameter of 308 mm and a thickness of 0.5 mm, and were spaced apart with straight radial caulks having a thickness of 0.5 mm.

The discs of the second type had a larger diameter, 328 mm, and had a separation surface with the same inclination with respect to the radial direction that extended to the outer diameter of the separation disc. The discs had further a thickness of 0.5 mm and had straight radial caulks of thickness 0.5 mm.

Results

The CFR was tested using liquids of two different densities, 35 cSt and 55 cSt. The results are summarized in Table 2 below:

TABLE 2

CFR values for the different disc stack configurations.

| Disc stack configuration No | CFR (m3/h) 55 cSt | CFR (m3/h) 35 cSt |
|---|---|---|
| Reference | 6.8 | 11.25 |
| 1 | 7.5 | 11.2 |
| 2 | 7.5 | 11.8 |
| 3 | 7.4 | n.a |

The results thus shows that all Configurations performed better than the Reference disc stack, and that having a single disc in the top (Configurations 2 and 3) performed as well or better compared to when having discs of larger diameter also in the middle of the disc stack (Configuration. 1). For Configuration 2, the increase in CFR was as high as 10% with the liquid of 55 cSt. This example thus highlights the significance of having a disc of larger diameter in the top of the disc stack.

The invention claimed is:

1. A centrifugal separator comprising:

a frame; and a drive member configured to rotate a rotating part in relation to the frame around an axis of rotation, wherein the rotating part comprises a centrifuge rotor enclosing separation chamber, wherein the separation chamber comprises a stack of separation discs arranged coaxially around the axis of rotation at a distance from each other to form passages between each two adjacent separation discs, and wherein the stack of separation discs comprises:

a first type of separation discs having an outer diameter of A or below;

a plurality of first openings in each of the first type of separation discs, each opening in each of first type of separation discs being at a first radial distance from the axis of rotation;

at least one separation disc of a second type having outer diameter B or above; and a plurality of second openings in each of the second type of separation discs, each opening in each of the second type of separation discs being at the first radial distance from the axis of rotation;

wherein the plurality of first openings and the plurality of second openings form distribution channels in the stack of separation discs, wherein diameter B is larger than diameter A, wherein at least one of the separation discs of the second type is arranged at a position in the disc stack that is within the upper 15% of the total number of separation discs and wherein at least one of said first type of separation disc is arranged axially above the uppermost separation disc of the second type, and wherein all of the separation discs of the second type are arranged within the upper 50% of the total number of separation discs.

2. The centrifugal separator according to claim 1, wherein the discs of the second type are distributed in the stack such that more discs of the second type are arranged within the upper 15% of the total number of separation discs than arranged within the rest of the disc stack.

3. The centrifugal separator according to claim 2, wherein at least one of the separation discs of the second type is arranged at a position in the disc stack that is within the upper 10-12% of the total number of separation discs.

4. The centrifugal separator according to claim 2, wherein the diameter B is 3-15% larger than the diameter A.

5. The centrifugal separator according to claim 2, wherein the disc stack comprises a single separation disc of the second type.

6. The centrifugal separator according to claim 1, wherein at least one of the separation discs of the second type is arranged at a position in the disc stack that is within the upper 10-12% of the total number of separation discs.

7. The centrifugal separator according to claim 6, wherein the diameter B is 3-15% larger than the diameter A.

8. The centrifugal separator according to claim 1, wherein the diameter B is 3-15% larger than the diameter A.

9. The centrifugal separator according to claim 1, wherein the disc stack comprises a single separation disc of the second type.

10. The centrifugal separator according to claim 1, wherein the separation disc of the second type has a separation surface with the same inclination with respect to the radial direction that extends to the outer diameter of the separation disc.

11. The centrifugal separator according to claim 10, wherein the separation disc of the second type has a brim portion formed radially outside the diameter A, said brim portion having an inclination to the radial direction different from the inclination of the separation surface.

12. The centrifugal separator according to claim 11, wherein the angle of the brim portion to the radial direction is less than 45 degrees.

13. The centrifugal separator according to claim 1, wherein the passages between each two adjacent separation discs are formed by caulks having a thickness that is less than 0.6 mm.

14. The centrifugal separator according to claim 1, wherein the passages between each two adjacent separation discs are formed by radial caulks.

15. The centrifugal separator according to claim 1, wherein the plurality of first openings are slits arranged at the perimeter of the disc to distribute the flow of fluid to be separated through and over the disc stack.

16. A method of separating impurities from oil comprising the steps of:

a) providing the centrifugal separator according to claim 1 and rotating said rotating part of said separator:

b) introducing the oil into the separation chamber; and c) discharging purified oil and separated impurities as two different phases from said separator.

17. The method according to claim 16, wherein the oil is selected from heavy fuel oil and lubrication oil.

18. A centrifugal separator comprising:

a frame; and a drive member configured to rotate a rotating part in relation to the frame around an axis of rotation, wherein the rotating part comprises a centrifuge rotor enclosing a separation chamber, wherein the separation chamber comprises a single stack of separation discs arranged coaxially around the axis of rotation at a distance from each other to form passages between each two adjacent separation discs, wherein the stack of separation discs comprises:

a first type of separation discs having an outer diameter of A or below;

a plurality of first openings in each of the first type of separation discs, each opening in each of the first type of separation discs being at a first radial distance from the axis of rotation;

at least one separation disc of a second type having outer diameter B above;

a plurality of second openings in each of the second type of separation discs, each opening in each of the second type of separation discs being at the first radial distance from the axis of rotation;

wherein the plurality of first openings and the plurality of second openings form distribution channels in the stack of separation discs, wherein diameter B is larger than diameter A, and wherein at least 50% of the separation discs of the second type are arranged at a position in the disc stack that is within the upper 25% of the total number of separation discs and wherein at least one of said first type of separation disc is arranged axially above the uppermost separation disc of the second type.

* * * * *